US006725624B2

(12) United States Patent
Hirath et al.

(10) Patent No.: US 6,725,624 B2
(45) Date of Patent: Apr. 27, 2004

(54) HEAT-INSULATING WALLING

(75) Inventors: Jürgen Hirath, Heidenheim (DE); Stefan Holzer, Giengen (DE)

(73) Assignee: BSH Bosch und Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/055,243

(22) Filed: Jan. 23, 2002

(65) Prior Publication Data

US 2002/0100250 A1 Aug. 1, 2002

Related U.S. Application Data

(63) Continuation of application No. PCT/EP00/07031, filed on Jul. 21, 2000.

(30) Foreign Application Priority Data

Jul. 23, 1999 (DE) ..... 299 12 917

(51) Int. Cl.[7] ..... E04C 2/38; E04C 1/00

(52) U.S. Cl. ..... 52/800.11; 52/800.12; 52/716.8; 52/309.8; 52/309.9

(58) Field of Search ..... 52/800.11, 800.12, 52/716.8, 309.9, 309.8

(56) References Cited

U.S. PATENT DOCUMENTS

| | | | | |
|---|---|---|---|---|
| 2,518,673 A | | 8/1950 | Ellsworth | |
| 2,743,980 A | * | 5/1956 | Hobbs | 52/782.2 |
| 2,821,754 A | * | 2/1958 | Hillson | 52/288.1 |
| 2,989,156 A | | 6/1961 | Brooks et al. | |
| 3,156,975 A | | 11/1964 | Shaw | |
| 3,349,533 A | * | 10/1967 | Gregoire | 52/282.2 |
| 4,161,567 A | * | 7/1979 | Sturgeon | 428/594 |
| 4,444,175 A | * | 4/1984 | Reynolds | 126/21 R |
| 4,633,678 A | * | 1/1987 | Lea et al. | 62/457.1 |
| 4,752,517 A | * | 6/1988 | Beitel | 156/70 |
| 4,985,106 A | | 1/1991 | Nelson | |
| 4,998,970 A | * | 3/1991 | Nelson | 122/19.2 |
| 5,277,035 A | * | 1/1994 | Fristoe et al. | 62/277 |
| 5,979,129 A | * | 11/1999 | Azar | 52/211 |
| 6,029,846 A | | 2/2000 | Hirath et al. | |
| 6,257,684 B1 | * | 7/2001 | Hirath et al. | 220/592.27 |
| 6,269,608 B1 | * | 8/2001 | Porter | 52/210 |

FOREIGN PATENT DOCUMENTS

| | | |
|---|---|---|
| DE | 197 45 861 A1 | 4/1999 |
| EP | 0 071 090 A1 | 2/1983 |
| EP | 0 658 716 A1 | 6/1995 |
| WO | WO 99/20960 * | 10/1998 |

* cited by examiner

*Primary Examiner*—Carl D. Friedman
*Assistant Examiner*—Kevin McDermott
(74) *Attorney, Agent, or Firm*—Laurence A. Greenberg; Werner H. Stemer; Gregory L. Mayback

(57) ABSTRACT

A heat-insulating walling includes an outer casing that is vacuum-tight as far as possible and with an inner lining being vacuum-tight as far as possible and spaced from the latter. The inner lining and the outer casing are connected to one another, vacuum-tight, by a connecting profile. The connecting profile has an at least approximately U-shaped cross section and has a diaphragm-like base. The connecting profile, together with the outer casing and the inner lining, surrounds an interspace filled with heat-insulation material. The U-shaped connecting profile can engage with its legs over the outer casing and the inner lining. The legs can be vacuum-tightly secured to the inner lining and the outer casing.

20 Claims, 3 Drawing Sheets

HEAT-INSULATING WALLING

CROSS-REFERENCE TO RELATED APPLICATION

This application is a continuation of copending International Application PCT/EP00/07031, filed Jul. 21, 2000, which designated the United States.

BACKGROUND OF THE INVENTION

Field of Invention

The invention relates to a heat-insulating walling with an outer casing that is vacuum-tight and with an inner lining spaced from the latter that is vacuum-tight. The inner lining and the outer casing are vacuum-tightly connected to one another by a connecting profile. The connecting profile has an at least approximately U-shaped cross section and has a diaphragm-like base. The connecting profile, together with the outer casing and the inner lining, surrounds an interspace filled with heat-insulation material.

Throughout the application, terms such as "vacuum tight" should be read with the understanding that perfect vacuums and perfect seals can never be achieved. However, within the scope of the invention, these terms are to mean as perfect as practicable for the materials, applications, and conditions. German Published, Non-Prosecuted Patent Application DE 197 45 861 A1, which corresponds to U.S. Pat. No. 6,029, 846 A, discloses a heat-insulating walling based on vacuum-insulation technology. The heat-insulating walling is for use in a refrigerator housing, a refrigerator door, or a muffle used in a domestic stove. The vacuum-insulating walling known from this publication possesses two cladding walls that are manufactured, for example, from high-grade steel and are vacuum tightly connected to one another by a connecting profile disposed at their free edges and built with a U-shaped cross section. For the vacuum-tight connection, the legs of the u-profile are welded to the free ends of the cladding walls, parallel to these, for example by a beam-welding method. Clamping and supporting tools are necessary for the welding operation, in particular so that the components to be welded to one another are braced suitably for welding purposes. These tools are to be introduced between the legs of the U-shaped connecting profile when the welding operation is being carried out, in order, on the one hand, to absorb the bracing forces of the components to be welded and, on the other hand, to prevent an excessive deformation of the components at their connection point. Although these measures ensure a process-consistent satisfactory manufacture of the heat-insulating housings and doors initially mentioned, the measures are complicated in manufacturing terms and therefore cost-intensive. Moreover, in this type of attachment of the U-shaped connecting profile, the space between the legs of the connecting profile has to be filled with heat-insulation material in order to avoid unnecessary heat or cold losses.

SUMMARY OF THE INVENTION

It is accordingly an object of the invention to provide a heat-insulating walling that overcomes the hereinaforementioned disadvantages of the heretofore-known devices of this general type and that improves heat-insulation walling in a simple construction.

With the foregoing and other objects in view, there is provided, in accordance with the invention, a heat-insulating walling. The heat insulating walling includes an as far as possible vacuum-tight outer casing, an as far as possible vacuum-tight inner lining spaced from the outer casing; a connecting profile vacuum-tightly connecting the inner lining and the outer casing; and heat-insulation material filling the interspace. The connecting profile has an at least approximately U-shaped cross section with legs and having a diaphragm-like base. The connecting profile, together with the outer casing and the inner lining, surround an interspace. The U-shaped connecting profile engages with the legs over the outer casing and the inner lining. The legs are vacuum-tightly secured to the inner lining and the outer casing.

This object of the invention is achieved by engaging the U-shaped connecting profile with its legs over the outer casing and the inner lining, and in that, the legs are vacuum-tightly secured to the inner lining and the outer casing.

According to the invention, the connecting profile is fastened in such a way that, in the fastening state of the profile, its legs bear with their inside on the outside of the outer casing and of the inner lining and are vacuum-tightly secured to the sides, for example by welding or adhesive bonding. This configuration prevents an interspace, such as those that occurs when the U-shaped connecting profile is attached in the conventional way and has to be filled with heat-insulation material to prevent heat-insulation losses. Furthermore, a possible risk of injury to the manufacturing personnel in the handling of the heat-insulating walling during its manufacturing is eliminated by virtue of the cap-like covering of the sharp-edged free margins of the inner lining or of the outer casing by the U-shaped connecting profile. Such risks are caused by the sharp edges produced when the outer casing or the inner lining are produced at the margins of these. Moreover, no tools are required to support the clamping forces occurring when the outer casing or the inner lining is braced by the legs of the U-shaped connecting profile suitably for welding purposes when an open-celled heat-insulation material of increased pressure resistance is used. The open-celled heat-insulation material of increased pressure can be, for example, an open-celled polymer foam, such as polystyrene foam sold under the trademark DOW INSTILL®. The open-celled heat-insulation material is pressed in order to increase the pressure resistance at an increased temperature that is above the glass temperature. As compared to the prior art, the U-shaped connecting profile slipped over the free ends of the outer casing and of the inner lining optimizes the heat-insulating wallings, because the wallings now possess a top-value heat-insulation capacity even at the connection point of their outer cladding walls.

According to a preferred embodiment of the subject of the invention, there is provision for a backing part to be provided on the inner lining and the outer casing, on the heat-insulation side, at least approximately over the length and height of the legs of the U-shaped connecting profile.

A backing part ensures that the heat occurring during the operation of welding the legs of the U-shaped connecting profile to the outer casing and the inner lining is as far as possible shielded from the open-celled heat-insulation material produced as a supporting body between the outer casing and the inner lining. As a result, the process management of the welding operation, to be precise the through-welding indispensable for the vacuum-type connection of the connecting profile to the outer casing or the inner lining, becomes markedly easier.

In accordance with a further object of the invention, a backing part for shielding the welding heat has been shown to be particularly beneficial. Welding heat is produced while welding the open-celled heat-insulation material introduced as a supporting body between the outer casing and the inner lining. The backing part has been shown to be particularly beneficial in terms of heat shielding, on the one hand, and of the execution of the welding process, on the other hand, when the backing element contains a high-grade steel strip or an aluminum strip with a material thickness having at least the material thickness of the outer casing or of the inner lining. Good heat shielding results have been shown even with material thicknesses of the order of one millimeter (1 mm).

In accordance with a further object of the invention, the U-shaped connecting profile for connecting the outer casing and the inner lining can be composed of a plurality of longitudinal portions. Ends of the longitudinal portions forming the joints are connected to one another as far as possible in a vacuum-tight manner.

Owing to the possibility that the connecting profile can be vacuum-tight fastened in portions between the inner lining and the outer casing along the margins to be connected, the production of the vacuum-tight connection, for example produced by adhesive bonding or welding, is considerably simplified. The simplification markedly reduces the manufacturing costs for the heat-insulating walling.

In accordance with a further object of the invention, U-shaped supporting elements can be provided on the joints. The U-shaped supporting elements bridges at least one of the joints. The ends of the U-shaped connecting parts lie on the U-shaped supporting elements and are connected in airtight manner. The end portions of the individual longitudinal portions are inserted one into the other along the margins of the outer casing and of the inner lining. Accordingly, the end portions can be vacuum-tight connected to one another with particular process consistency. The supporting elements serve as a bearing from the diaphragm-like base of the connecting profiles. Simultaneously, the support elements make the vacuum-tight connection of the ends of the longitudinal portions of the joints easier.

In accordance with a further object of the invention, the U-shaped supporting element can be secured with its legs to the inner lining and the outer casing on the heat-insulation side. Accordingly, U-shaped supporting elements can be more-easily secured to the outer casing, on the one hand, and the inner lining, on the other hand.

In accordance with a further object of the invention, the U-shaped connecting profile can be covered by a U-shaped covering profile that engages with its legs over the legs of the connecting profile and is held on the latter. By virtue of the U-shaped configuration of the covering profile, the connecting profile is protected both by its legs, vacuum-tightly secured to the outer casing and to the inner lining, for example by welding or adhesive bonding, and on its impact-sensitive diaphragm-like base.

In accordance with a further object of the invention, the covering profile can have holders for holding it. The holders can hold the covering profile with its base at a distance from the base of the connecting profile to form a receiving space.

By providing an interspace between the impact-sensitive base of the connecting profile and the base of the covering profile, the connecting profile is protected even in the event of relatively high impact load on the covering profile. Moreover, the interspace makes it possible in a space-saving and aesthetic way to attach and accommodate further functional parts, for example an anchor for a magnetic seal used in a refrigerated door, or a heating line for preventing condensation from forming in a refrigerator housing in the region of its access opening.

In accordance with a further object of the invention, the holder on the covering profile can be configured as holding strips disposed on the inside of its legs at a distance corresponding to the height of the connecting profile. Accordingly, the covering profile is held particularly accurately in position in terms of the formation of the receiving space.

In accordance with a further object of the invention, the receiving space can serve for introducing a line-like heating device held on the covering profile. As a result, the line-like heating device is disposed particularly inconspicuously and particularly favorably in terms of the introduction of heat to prevent condensation from forming in a refrigerator housing at its access opening.

In accordance with a further object of the invention, the inner lining, the outer casing, and the connecting profile are formed from thin-walled high-grade steel or aluminum-coated plastic. As a result, a heat-insulating walling is formed that is particularly robust and resistant with regard to maintaining the vacuum generated between the outer casing and the inner lining.

In accordance with a further object of the invention, the door and/or housing of a refrigerator include a heat-insulating walling as described above. The refrigerator will have improved heat-insulation capacity in relation to the insulating wall thicknesses necessary for this purpose.

In accordance with a further object of the invention, a domestic stove including a heat-insulating muffle surrounding a baking space can have a heat-insulating walling. The stove has increased heat-insulation capacity in light of the thickness of the heat-insulating wallings that are to be employed for this purpose.

Other features which are considered as characteristic for the invention are set forth in the appended claims.

Although the invention is illustrated and described herein as embodied in a heat-insulating walling, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
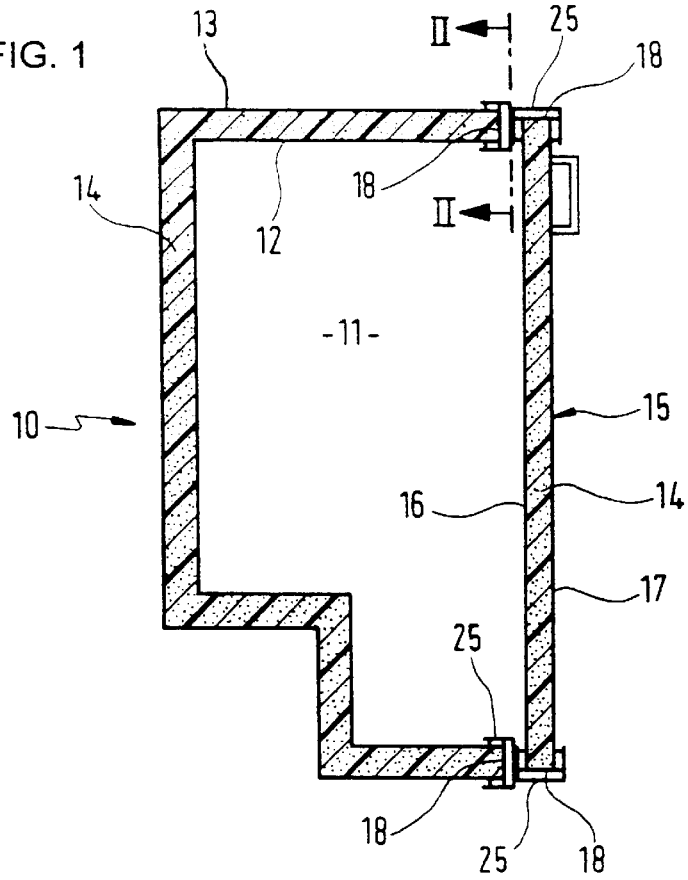
FIG. 1 is a diagrammatic, lateral-sectional diagrammatic view showing a heat-insulating housing, such as a domestic refrigerator, with a outer casing, an inner lining spaced from the latter, and a connecting profile vacuum-tightly connecting their free margins to one another and covered by a covering profile.

Referring now to the figures of the drawings in detail and first, particularly to FIG. 1 thereof, there is shown a heat-insulating housing 10 suitable for a domestic refrigerator, such as a chill cabinet or freezer, using vacuum-insulation technology. Within the heat-insulating housing 10, a useful space 11 constructed, for example, as a refrigerating or freezing space. This is lined with a vacuum-tight inner lining 12 formed, for example, from a 0.4 mm thick high-grade sheet steel or corrosion protecting sheet steel. Spaced from the inner lining 12, a vacuum-tight outer casing 13 is provided, which is likewise formed from 0.4 mm thick high-grade sheet steel or corrosion-protected sheet steel. The vacuum-tight outer casing 13 together with the inner lining 12 forms the cladding layers of the housing 10. Between the outer casing 13 and the inner lining 12, an evacuatable heat-insulation material 14 is disposed. Examples of heat-insulation material 14 include open-celled polyurethane foam or open-celled polystyrene foam, serving for supporting the inner lining 12 or the outer casing 13 in the evacuated state of the housing 10. Heat-insulation material 14 of this type also serves as a heat-insulating evacuatable filling of a door 15, which is fastened pivotably to the housing 10. The door 15, like the housing 10, possesses, on its inside facing the useful space 11, a vacuum-tight inner lining 16 and a vacuum-tight outer casing 17 which is spaced from the latter and, like the inner lining 16, is formed, for example, from high-grade sheet steel or corrosion-protected sheet steel with a material thickness of 0.4 mm at least as far as possible by non-cutting machining. For the vacuum-tight connection of the inner lining 16 to the outer casing 17 or of the inner lining 12 to the outer casing 13, there is provided, continuously along their free margins, a connecting profile 18 of U-shaped cross section. The connecting profile 18 is constructed identically to the door 15 and the housing 10. The connecting profile 18 serves for producing the door body, together with the inner lining 16 and the outer casing 17, and for producing the housing body, together with the inner lining 12 of the outer casing 13, and, together with the cladding walls of the door 15 or the cladding walls of the housing 10, the connecting profile 18 surrounds an evacuatable interspace that is filled with the heat-insulation material 14 for supporting the inner lining 12 and the outer casing 13, serving as cladding walls, or for supporting the inner lining 16 and the outer casing 17, in the evacuated state of the housing 10 or of the door 15 respectively.

Viewing FIGS. 2 to 4, the connecting profile 18, described below by the example of the housing 10, has two u-profile legs 19 which are connected to one another by a diaphragm-like thin-walled base 20, the base 20 and the u-profile legs 19. The u-profile legs 19 are essentially the material thickness of the inner linings or of the outer casings and are formed from vacuum-tight material, such as, for example, high-grade steel or the like. The connecting profile 18 engages with its u-profile legs 19 over the inner lining 16 and the outer casing 17 or the inner lining 12 and the outer casing 13, in such a way that their outside comes into bearing contact with the inside of the u-profile legs 19 and the base 20 comes with its inside into bearing contact with the free ends of the inner lining 12 or 16 and of the outer casing 13 or 17.

Figure 4:
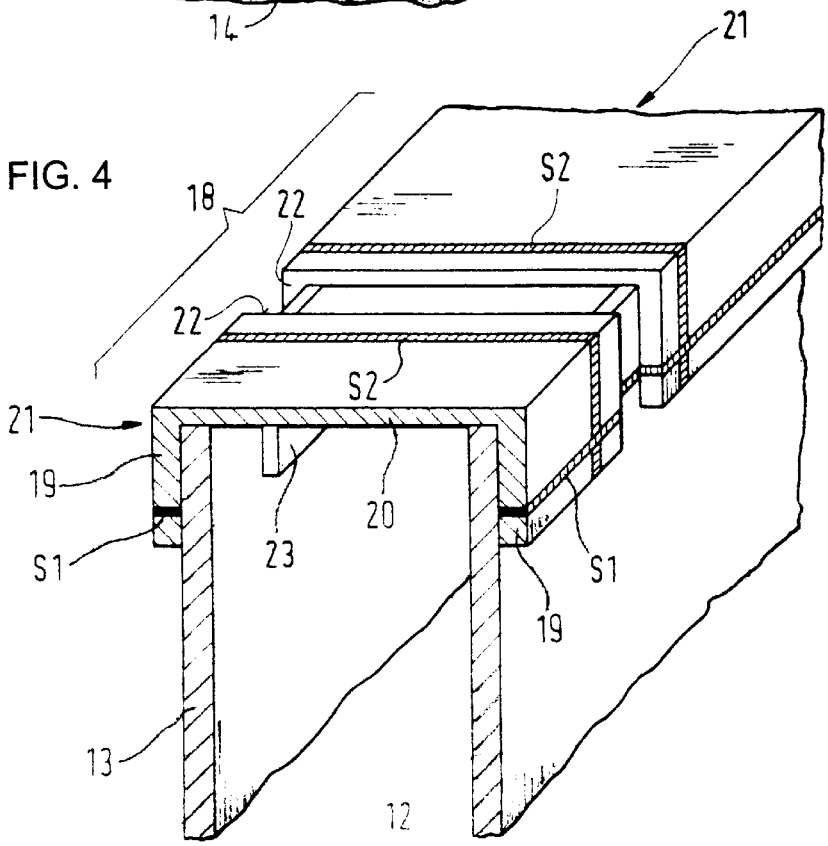
FIG. 4 is a partially-sectional perspective view showing the connecting profile assembled from individual longitudinal portions and supported at the joint by a supporting element, with cladding walls of the heat-insulating housing which are vacuum-tightly secured to said connecting profile.
Figure 5:
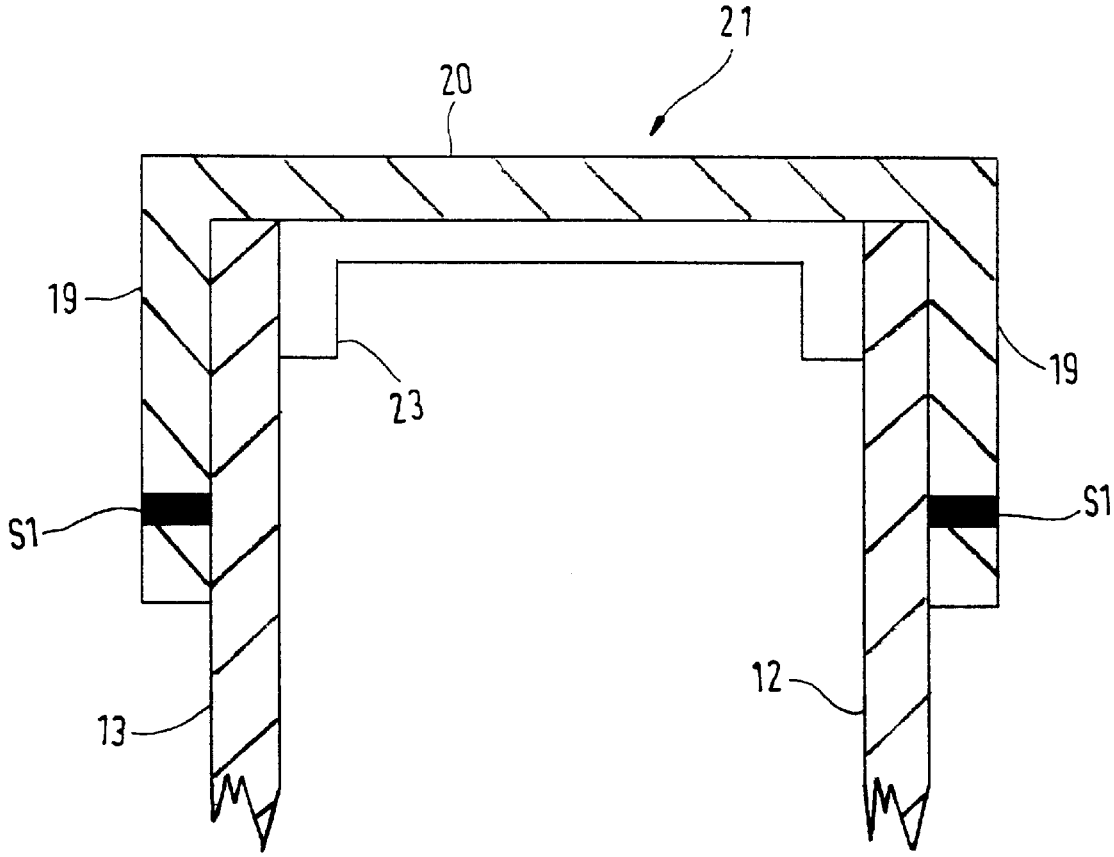
FIG. 5 is a diagrammatic sectional view showing the connecting profile of FIG. 4.

As shown particularly in FIG. 4, the connecting profile 18, configured with a U-shaped cross section, is subdivided into a plurality of longitudinal portions 21 along the free margins, to be connected in a vacuum-tight manner, between the inner lining 12 and the outer casing 13 of the inner lining 16 and the outer casing 17, the ends 22, disposed at a particular assembly distance from one another, of said longitudinal portions being supported on a supporting element 23 configured in cross section as a u-profile. The latter is secured with its legs to the mutually confronting insides of the inner lining 12 and of the outer casing 13 or of the inner lining 16 and the outer casing 17, the base of the U-shaped supporting element 23 being flush, at least essentially at the same height, with the free ends of the inner lining 12 or 16 and of the outer casing 13 or 17 and serving as a bearing surface for the diaphragm-like base 20 of the portions 21. The supporting elements 23 have adjoining them flat-profile backing elements 24, which are formed at approximately the same height as the legs of said supporting elements and the material thickness of which corresponds essentially to that of the legs of the supporting elements 23. The backing elements 24, which are manufactured from material with low thermal conductivity, such as, for example, high-grade steel or the like, serve, like the legs of the supporting elements 23 likewise manufactured from high-grade steel, for as far as possible shielding from the heat-insulation material 14 the heat that occurs during the vacuum-tight welding of the connecting profile 18 to the inner lining 12 and the outer casing 13 or to the inner lining 16 and the outer casing 17 by a beam-welding method. For the vacuum-tight fastening of the connecting profile 18 to the inner lining 12 and the outer casing 13 or the inner lining 16, there are provided, on the one hand, weld seams S1 that run along the u-profile legs 19 and the welding depth of which extends as far as the backing elements 24 or, in the region of the supporting elements 23, into the legs of the latter. In the region of the supporting elements 23 are provided weld seams S2 that run over the height of the u-profile legs 19 and transversely to the base 20 and intersect with the weld seams S1 in the region of the u-profile legs 19, with the result that the connecting profile 18 formed from individual longitudinal portions 21 is vacuum-tightly secured to the inner lining 12 and the outer casing 13 or the inner lining 16 and the outer casing 17 both in the region of the supporting elements 23 and in the region outside these.

Figure 2:
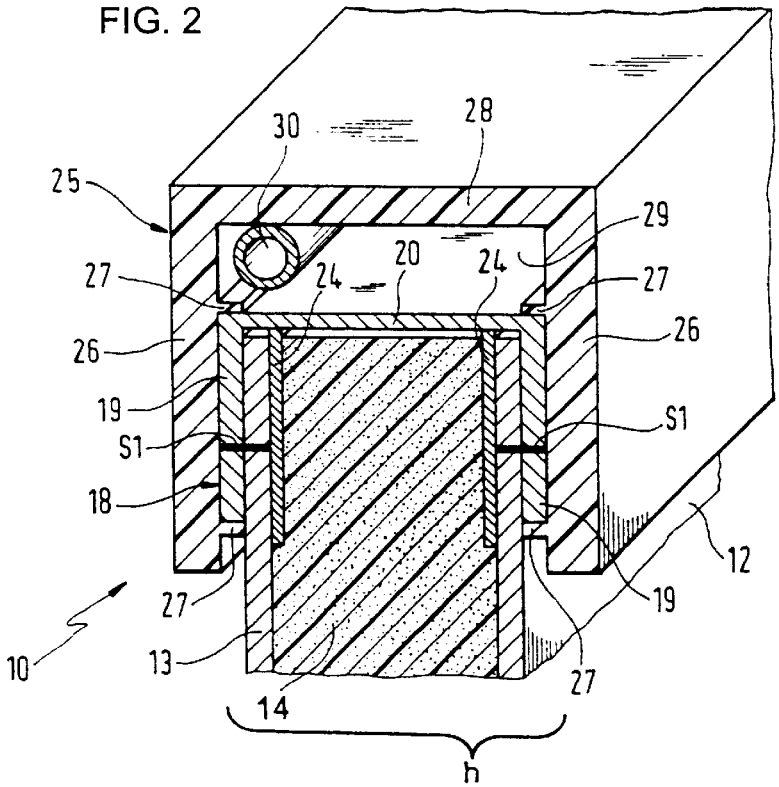
FIG. 2 is an enlarged, partially-sectional perspective view of the housing taken along the sectional line II—II in FIG. 1.
Figure 3:
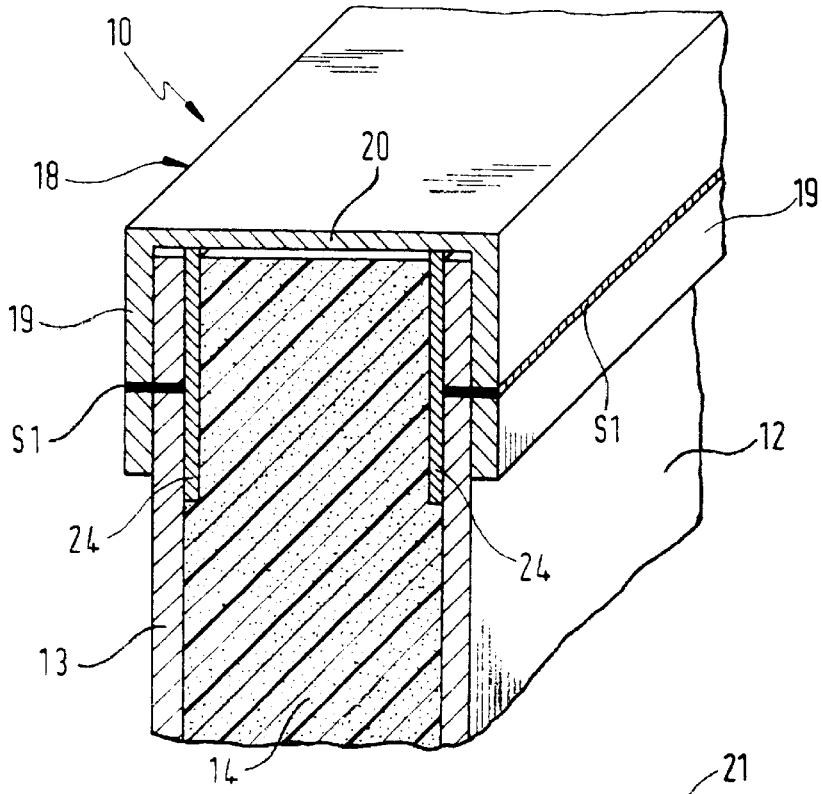
FIG. 3 is a partially-sectional, perspective view showing the housing without a covering profile in the region of its connecting profile.

To protect the connecting profile 18, a covering profile 25 constructed with a U-shaped cross section and manufactured, for example, from injection-molded plastic is provided along said connecting profile, as shown particularly in FIG. 2. In the mounting state, the covering profile 25 is slipped over the connecting profile 18 and possesses u-profile legs 26 that project with their free end in relation to the free end of the u-profile legs 19 and are provided on their mutually confronting insides with integrally formed holding strips 27 that run at a parallel distance from one another along the u-profile legs 26. In each case one of the holding strips 27 is provided in the region near the free end of each u-profile leg 26, while the other holding strips 27 are disposed nearer to the root of the u-profile legs 26 and are spaced, at a clear distance corresponding to the lateral height h of the connecting profile 18, from the holding strips 27 provided at the free leg ends. Provided at a distance above the near-root holding strips 27 is a base 28 that connects the two u-profile legs 26 to one another and which, in the mounting state of the covering element 25, is disposed at a distance above the base 20, with the result that an interspace 29 is formed. In the mounting state of the covering element 25, in which the latter is held positively on the connecting profile 18 by its holding strips 27 provided on the u-profile legs 26 and in each case receiving between them the lateral portion of the connecting profile 18, the interspace 29 formed thereby has introduced into it a heating line 30 serving as a heating device, for example in the form of a hot-gas line, to prevent condensation from forming on the connecting profile 18, said heating line being secured to the covering element 25 by holders that are not shown.

We claim:

1. A heat-insulating walling, comprising:

an outer casing;

an inner lining;

a connecting profile vacuum-tightly connecting said inner lining and said outer casing, said connecting profile having an at least approximately U-shaped cross section with legs with a height and width and having a diaphragm-like base; said connecting profile, together with said outer casing and said inner lining, surrounding an interspace; a first of said legs of said U-shaped connecting profile engaging and overlaying said outer casing and a second of said legs of said U-shaped connecting profile engaging and overlaying said inner lining; said legs being vacuum-tightly secured to said inner lining and said outer casing;

heat-insulation material filling said interspace;

said inner lining and said outer casing each having a side facing said heat-insulation material; and a backing element provided on the heat-insulation side of said inner lining and said outer casing, at least over the length and height of said legs of said U-shaped connecting profile.

2. The heat-insulating walling according to claim 1, wherein:

said backing element includes a strip with a material thickness having at least the material thickness of at least one of said outer casing and said inner lining; and said strip is selected from the group of materials consisting of high-grade steel and aluminum.

3. The heat-insulating walling according to claim 1, wherein said U-shaped connecting profile for connecting said outer casing and said inner lining includes a plurality of longitudinal portions having ends, said ends being connected to one another to form vacuum-tight joints.

4. The heat-insulating walling according to claim 3, including a U-shaped supporting element supporting said connecting profile by bridging at least one of said joints of said connecting profile.

5. The heat-insulating walling according to claim 4, wherein said legs of said U-shaped supporting element secure said U-shaped supporting element to said inner lining and said outer casing on said heat-insulation side.

6. The heat-insulating walling according to claim 1, including a U-shaped covering profile having covering-profile legs and covering said U-shaped connecting profile, said covering-profile legs being engaged said legs of said connecting profile to hold said covering profile on said connecting profile.

7. The heat-insulating walling according to claim 6, wherein said covering profile includes a base and holders;

said holders holding said base of said covering profile at a distance from said base of said connecting profile to define a receiving space.

8. The heat-insulating walling according to claim 7, wherein said holders on said covering profile are constructed as holding strips disposed inside of said legs of said covering profile at a distance corresponding to the height of said connecting profile.

9. The heat-insulating walling according to claim 7, including a line-like heating device held on said covering profile disposed in said receiving space.

10. The heat-insulating walling according to claim 1, wherein said inner lining, said outer casing and said connecting profile are formed from a material selected from the group consisting of high-grade steel and aluminum-coated plastic.

11. The heat-insulating walling according to claim 1, wherein said heat-insulation material is formed from open-celled polymer foam having been heated above a glass transition temperature of said open-celled polymer foam and compacted under pressure while above a glass transition temperature.

12. A refrigerator, comprising:

a heat-insulating housing; and a heat-insulating door connected to said heat-insulating housing;

said housing and said door including a heat-insulating walling, said heat insulating walling having:

an outer casing;

an inner lining spaced from said outer casing;

a connecting profile vacuum-tightly connecting said inner lining and said outer casing, said connecting profile having an at least approximately U-shaped cross section with legs with a height and a width and having a diaphragm-like base; said connecting profile, together with said outer casing and said inner lining, surrounding an interspace; a first of said legs of said U-shaped connecting profile engaging and overlaying said outer casing and a second of said legs of said U-shaped connecting profile engaging and overlaying said inner lining; said legs being vacuum-tightly secured to said inner lining and said outer casing;

heat-insulation material filling said interspace;

said inner lining and said outer casing each having a side facing said heat-insulation material; and a backing element provided on the heat-insulation side of said inner lining and said outer casing, at least over the length and height of said legs of said U-shaped connecting profile.

13. A domestic stove, comprising:

a heat-insulating muffle surrounding a baking space, said muffle including a heat-insulating walling having:

an outer casing;

an inner lining spaced from said outer casing;

a connecting profile vacuum-tightly connecting said inner lining and said outer casing, said connecting profile having an at least approximately U-shaped cross section with legs with a height and width and having a diaphragm-like base; said connecting profile, together with said outer casing and said inner lining, surrounding an interspace; a first of said legs of said U-shaped connecting profile engaging and overlaying said outer casing and a second of said legs of said U-shaped connecting profile engaging and overlaying said inner lining; said legs being vacuum-tightly secured to said inner lining and said outer casing;

heat-insulation material filling said interspace;

said inner lining and said outer casing each having a side facing said heat-insulation material; and a backing element provided on the heat-insulation side of said inner lining and said outer casing, at least over the length and height of said legs of said U-shaped connecting profile.

14. A water-carrying domestic appliance, comprising:

a heat-insulating housing including a heat-insulating walling having:

an outer casing;

an inner lining spaced from said outer casing;

a connecting profile vacuum-tightly connecting said inner lining and said outer casing, said connecting profile having an at least approximately U-shaped cross section with legs with a height and width and having a diaphragm-like base; said connecting profile, together with said outer casing and said inner lining, surrounding an interspace; a first of said legs of said U-shaped connecting profile engaging and overlaying said outer casing and a second of said legs of said U-shaped connecting profile engaging and overlaying said inner lining; said legs being vacuum-tightly secured to said inner lining and said outer casing;

heat-insulation material filling the interspace;

said inner lining and said outer casing each having a side facing said heat-insulation material; and a backing element provided on the heat-insulation side of said inner lining and said outer casing, at least over the length and height of said legs of said U-shaped connecting profile.

15. A heat-insulating walling, comprising:

an outer casing;

an inner lining;

a connecting profile vacuum-tightly connecting said inner lining and said outer casing, said connecting profile having an at least approximately U-shaped cross section with legs and having a diaphragm-like base; said connecting profile, together with said outer casing and said inner lining, surrounding an interspace; a first of said legs of said U-shaped connecting profile engaging and overlaying said outer casing and a second of said legs of said U-shaped connecting profile engaging and overlaying said inner lining; said legs being vacuum-tightly secured to said inner lining and said outer casing; said U-shaped connecting profile, including a plurality of longitudinal portions having ends, said ends being connected to one another to form vacuum-tight joints;

heat-insulation material filling said interspace; and a U-shaped supporting element supporting said connecting profile by bridging at least one of said joints of said connecting profile.

16. The heat-insulating walling according to claim 15, wherein said legs of said U-shaped supporting element secure said U-shaped supporting element to said inner lining and said outer casing on said heat-insulation side.

17. A heat-insulating walling, comprising:

and out casing;

an inner lining;

a connecting profile vacuum-tightly connecting said inner lining and said outer casing, said connecting profile having an at least approximately U-shaped cross section with legs and having a diaphragm-like base; said connecting profile, together with said outer casing and said inner lining, surrounding an interspace; a first of said legs of said U-shaped connecting profile engaging and overlaying said outer casing and a second of said legs of said U-shaped connecting profile engaging and overlaying said inner lining; said legs being vacuum-tightly secured to said inner lining and said outer casing;

heat-insulation material filling said interspace; and a U-shaped covering profile having covering-profile legs and covering said U-shaped connecting profile, said covering-profile legs being engaged said legs of said connecting profile to hold said covering profile on said connecting profile.

18. The heat-insulating walling according to claim 17, wherein said covering profile includes a base and holders;

said holders holding said base of said covering profile at a distance from said base of said connecting profile to define a receiving space.

19. The heat-insulating walling according to claim 18, wherein said holder on said covering profile are constructed as holding strips disposed inside of said legs of said covering profile at a distance corresponding to the height of said connecting profile.

20. The heat-insulating walling as claimed in claim 18, including a line-like heating device held on said covering profile disposed in said receiving space.

* * * * *